US006837258B1

(12) United States Patent
Loreto

(10) Patent No.: US 6,837,258 B1
(45) Date of Patent: Jan. 4, 2005

(54) VACUUM OPERATED SEALED LIQUID ACCUMULATOR

(75) Inventor: Enrique P. Loreto, Fullerton, CA (US)

(73) Assignee: AcornVac, Inc., Chino, CA (US)

( * ) Notice: Subject to any disclaimer, the term of this patent is extended or adjusted under 35 U.S.C. 154(b) by 0 days.

(21) Appl. No.: 10/319,888

(22) Filed: Dec. 16, 2002

(51) Int. Cl.[7] ..... F04F 3/00
(52) U.S. Cl. ..... 137/205; 137/907
(58) Field of Search ..... 137/205, 907

(56) References Cited

U.S. PATENT DOCUMENTS 4,603,709 A * 8/1986 Huisma ..... 137/205
6,305,403 B1 10/2001 von Palffy et al. ..... 137/205
6,385,789 B1 5/2002 Pondelick et al. ..... 4/427

OTHER PUBLICATIONS

US 6,311,717, 11/2001, Stradinger et al. (withdrawn)

* cited by examiner

*Primary Examiner*—Gerald A. Michalsky
(74) *Attorney, Agent, or Firm*—Edgar W. Averill, Jr.

(57) ABSTRACT

A sealed liquid accumulator for accumulating a liquid in a box which is sealed to prevent the escape of odors from the interior of the box. The accumulator has an outlet tube for evacuating liquid from the interior of the box by way of a vacuum. A source of replacement air is supplied to the box through a controlled valve.

8 Claims, 2 Drawing Sheets

VACUUM OPERATED SEALED LIQUID ACCUMULATOR

BACKGROUND OF THE INVENTION

The field of the invention is plumbing fixtures and the invention relates more particularly to a plumbing system for collecting accumulated liquids in an accumulator and emptying the accumulated liquid when the accumulator is filled to a predetermined level. The system is vacuum operated.

Various vacuum operated plumbing fixtures are known. One such fixture is shown in U.S. Pat. No. 6,305,403 wherein a buffer 14 collects liquid and is emptied by pulling a vacuum at one end of the buffer.

U.S. Pat. No. 6,311,717 discloses an accumulator system utilizing a pair of buffer boxes 30 which are emptied by a vacuum.

U.S. Pat. No. 6,385,789 shows a vacuum galley waste disposal system which is activated by pushing a button which initiates rinse water to the basin and opens a valve between the drain of the basin and a collection tank maintained under vacuum.

In some applications where the liquid being accumulated is malodorous, it is beneficial to provide a means for sealing the system so that the odor from the accumulator cannot escape into the surrounding atmosphere. The system is preferably operated by a vacuum without the need for any electrical input.

BRIEF SUMMARY OF THE INVENTION

It is an object of the present invention to provide a vacuum operated liquid accumulator which is sealed so that odor from within the accumulator cannot reach the surrounding exterior of the accumulator.

The present invention is for a vacuum operated sealed liquid accumulator having a sealed accumulator box. An outlet tube passes into the interior of the box and has an outlet port near the bottom of the box. The outlet tube is connected to an outlet line, which in turn is provided with a source of vacuum. An outlet valve is opened and closed in response to a signal received from a controller. The outlet valve is positioned between the outlet tube and the source of vacuum. An atmospheric air input port is located in the top of the sealed accumulator box. The air input port is connected to a replacement air line which has an air intake opening. An air intake valve, when opened, provides a passage of atmospheric air into the interior of the accumulator box, and when closed, prevents the passage of air into or out of the air intake line. A liquid inlet line is connected to the sealed accumulator box for introducing liquids into the interior of the box. A controller, having a sensor port connected to a control pipe within the interior of the sealed accumulator box, provides a signal to the outlet valve and to the air intake valve. When such signal is received, the outlet tube pulls liquid out of the interior of the accumulator box and the air replacement line replaces the removed liquid with atmospheric air. After the box is appropriately emptied, both valves are closed.

DESCRIPTION OF THE PREFERRED EMBODIMENTS

Figure 1A:
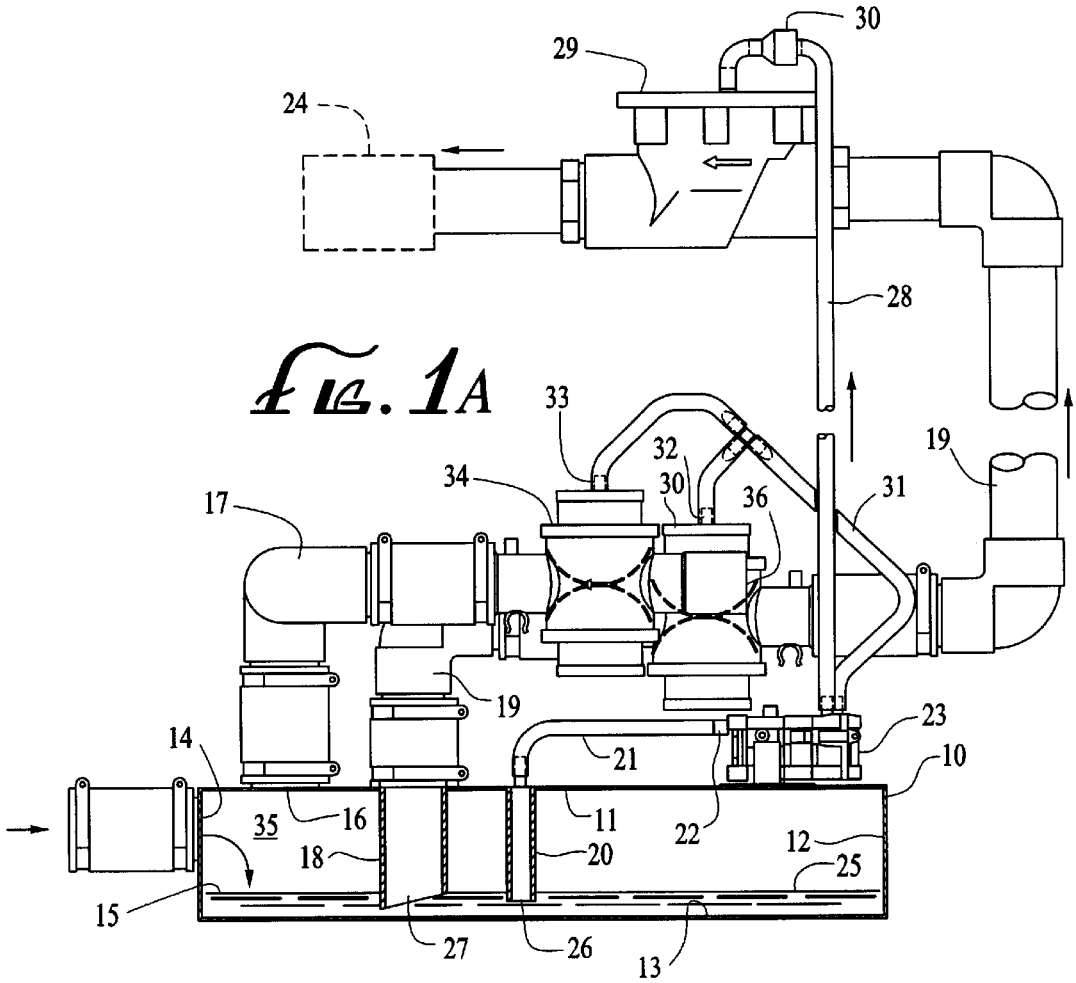
FIG. 1A is a side view of the vacuum operated sealed accumulator of the present invention showing the liquid at a low level.
Figure 2:
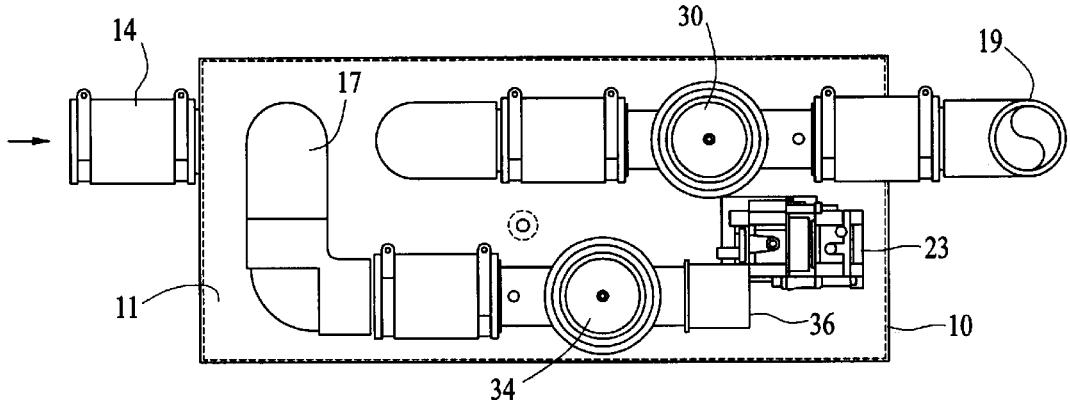
FIG. 2 is a top view thereof.

A sealed accumulator box 10 has a top 11, side walls 12, and a bottom 13. Box 10 is sealed with the exception of four openings. One opening is an inlet port 14 through which liquid 15 is introduced through inlet line 14'. The second opening is an atmospheric air intake port 6 to which replacement air line 17 is sealed. Air intake port 6 is located above liquid level 25 when box 10 is in its uppermost level as shown in FIG. 1B. It may be positioned in the side of box 10 or as shown in the drawings in the top 11. The third opening is for outlet tube 18 which leads to outlet line 19. The fourth opening is for control pipe 20 which is connected to control tubing 21, which leads to the inlet port 22 of a pneumatic controller 23. Control pipe 20 has a riser portion within the sealed accumulator box 10.

Figure 1B:
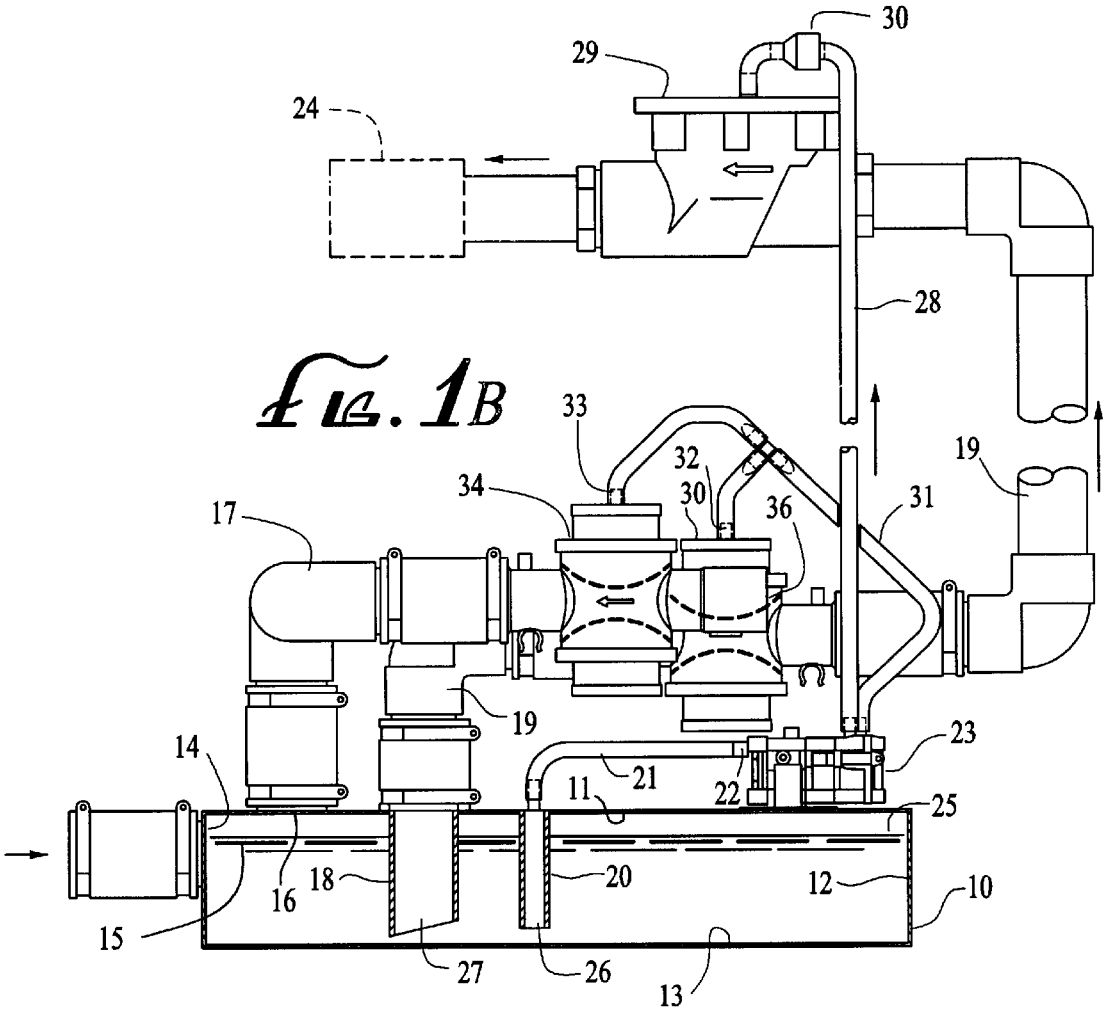
FIG. 1B is a side view thereof showing the liquid at an almost full level.

Outlet line 19 leads to a source of vacuum and to a liquid waste disposal site indicated by box 24 in FIG. 1A.

Liquid level 25 in FIG. 1A is near bottom 13 and just covers opening 26of control pipe 20.

Pneumatic controller 23 is supported by the top 11 of box 10 and has a vacuum supply line 28 which is connected to a 2" swing check valve 29. Check valve 30 is positioned in vacuum supply line 28.

Outlet valve 30 is positioned in outlet line 19 and is a normally closed valve. Thus, outlet line 19 between the source of vacuum 24 and outlet valve 30 is maintained under vacuum.

Returning to the pneumatic controller 23, such a valve is shown in U.S. Pat. No. 6,311,718 assigned to the assignee of the present invention, which patent is incorporated by reference herein for background purposes. When the inlet port 22 of pneumatic controller 23 is provided with a small amount of pressure caused by the increase in liquid level 25 in FIG. 1B, the pneumatic controller outputs a vacuum to output control line 31. Output control line 31 leads to the control ports 32 and 33 of outlet valve 30 and air intake valve 34, respectively.

Thus, as the liquid level rises in sealed accumulator box 10 to a level shown in FIG. 1B, the pressure in control tubing 21 and at inlet port 22 increases sufficiently to activate pneumatic controller 23. When controller 23 is activated, a vacuum is imposed in outlet control line 31, thereby opening outlet valve 30 and air intake valve 34. The opening of outlet valve 30 causes the liquid 15 within the interior volume 35 of box 10 to be pulled through outlet tube 18, outlet line 19, and into the liquid waste disposal 24. At the same time, the opening of air intake valve 34 permits air to pass into air intake opening 36. Note that the only time the interior volume 35 of box 10 is connected to the opening is while a vacuum is being applied on outlet tube 18. Thus, malodorous vapors can never escape the sealed accumulator box.

Once the interior volume 35 is essentially emptied of liquid, the opening 26 of control pipe 20 is exposed to atmospheric pressure. This causes the pressure in control tubing 21 to return to atmospheric pressure, thereby turning off pneumatic controller 23. The turning off of pneumatic controller 23 causes the vacuum in output control line 31 to return to atmospheric pressure, thereby causing outlet valve 30 and air intake valve 34 to close.

Valves 30 and 34 are preferably pinch valves of the type known in U.S. Pat. No. 6,394,411, which is incorporated by reference herein. Such valves are normally closed and when opened, rapidly provide a large liquid or vapor passageway. For instance, 1" valves can be used which eliminate essentially any pressure drop so that the opening of air intake valve 34 quickly increases the pressure within accumulator box 10 to atmospheric pressure.

The vacuum operated sealed liquid accumulator of the present invention is particularly useful in the disposal of waste from plumbing fixtures such as urinals and operates without any source of electricity.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A vacuum operated sealed liquid accumulator comprising:

a sealed accumulator box having a bottom, side walls, a top, an inlet port, and an interior volume;

an outlet tube supported by said accumulator box, said outlet tube having an outlet tube entry port positioned within the interior volume adjacent the bottom and said outlet tube being connected to an outlet line;

a source of vacuum connected to said outlet line;

an outlet valve having means for being remotely opened and closed in response to a signal received from a controller, said outlet valve being in a normally closed configuration, said outlet valve being located in said outlet line between said outlet tube and said source of vacuum;

an atmospheric air input port located in the top of said sealed accumulator box, said atmospheric air input port being connected to a replacement air line, said replacement air line having an air intake opening and an air intake valve, said air intake valve having means for being remotely opened and closed in response to a signal received from a controller and said air intake valve being in a normally closed configuration;

a liquid inlet line connected to said sealed accumulator box for introducing liquids into the interior of said sealed accumulator box;

a controller having a sensor port connected to a control pipe having a riser portion within the interior volume of said sealed accumulator box, said control pipe riser portion having an opening in a lower end thereof whereby when a level of liquid rises in the interior volume of said sealed accumulator box, the pressure in said control pipe increases to a controller activating pressure, said controller having an output control line leading to said air intake valve and said outlet valve, whereby when said controller activating pressure is reached, the output control line sends a signal and both the air intake valve and the outlet valve are opened causing the liquid within the interior volume of said sealed accumulator box to be pulled by vacuum through the outlet tube and outlet line and for replacement air to be passed into the interior volume to maintain the air within the interior volume at atmospheric pressure; and means for turning off said signal from said controller to cause said air intake valve and the outlet valve to close.

2. The vacuum operated sealed liquid accumulator of claim 1 wherein said outlet tube is supported by the top of said sealed accumulator box.

3. The vacuum operated sealed liquid accumulator of claim 1 wherein said controller outputs vacuum to said output control line.

4. The vacuum operated sealed liquid accumulator of claim 1 wherein said means for turning off said signal from said controller is initiated by pressure in the control pipe riser portion and control tubing reaching atmospheric pressure.

5. The vacuum operated sealed liquid accumulator of claim 1 wherein said control pipe riser portion in said interior volume is vertically oriented.

6. The vacuum operated sealed liquid accumulator of claim 1 wherein said controller is supported by the top of said sealed accumulator box.

7. A vacuum operated sealed liquid accumulator comprising:

a sealed accumulator box having a bottom, side walls, a top, an inlet port, and an interior volume;

an outlet tube supported by the top of said accumulator box, said outlet tube having an outlet port positioned within the Interior volume and having an outlet port positioned adjacent the bottom and said outlet tube being connected to an outlet line;

a source of vacuum connected to said outlet line;

an outlet valve having means for being remotely opened and closed in response to a signal received from a controller, said outlet valve being in a normally closed configuration, said outlet valve being located in said outlet line between said outlet tube and said source of vacuum;

an atmospheric air input port located in said sealed accumulator box, said atmospheric air input port being connected to a replacement air line, said replacement air line having an air intake opening and an air intake valve, said air intake valve having means for being remotely opened and closed in response to a signal received from a controller and said air intake valve being in a normally closed configuration;

a liquid inlet line connected to said sealed accumulator box for introducing liquids into the interior of said sealed accumulator box;

a controller having a sensor port connected to a control pipe within the interior volume of said sealed accumulator box, said control pipe having an opening in a lower end thereof whereby when a level of liquid rises in the interior volume of said sealed accumulator box, the pressure in said control pipe increases to a controller activating pressure, said controller being provided with a source of vacuum and having an output control line leading to said air intake valve and said outlet valve, whereby when said controller activating pressure is reached, the output control line directs a vacuum to both the air intake valve and the outlet valve thereby opening said air intake and outlet valves causing the liquid within the interior volume of said sealed accumulator box to be pulled by vacuum through the outlet tube and outlet line and for replacement air to be passed into the interior volume to maintain the air within the interior volume at atmospheric pressure; and means for turning off said signal from said controller to cause said air intake valve and the outlet valve to close.

8. The vacuum operated sealed liquid accumulator of claim 7 wherein said outlet valve and said air intake valve are vacuum operated and are closed when atmospheric air is in said output control line.

* * * * *